United States Patent [19]

Chou et al.

[11] Patent Number: 4,917,726

[45] Date of Patent: Apr. 17, 1990

[54] CHROMIUM RECOVERY PROCESS

[75] Inventors: Eddie C. J. Chou; Leo W. Beckstead; Charles J. Kucera, Jr., all of Arvada, Colo.; Pandelis Papafingos, Riverside, Calif.

[73] Assignee: Amax Inc., Greenwich, Conn.

[21] Appl. No.: 263,966

[22] Filed: Oct. 26, 1988

Related U.S. Application Data

[63] Continuation of Ser. No. 43,673, Apr. 16, 1987, abandoned.

[51] Int. Cl.[4] ..... C22B 34/32

[52] U.S. Cl. ..... 75/623; 75/959

[58] Field of Search ..... 75/27, 85, 7, 101 BE; 423/24, 55, 140

[56] References Cited

U.S. PATENT DOCUMENTS

| | | | |
|---|---|---|---|
| 4,150,975 | 4/1979 | Miyake et al. | 75/27 |
| 4,162,294 | 7/1979 | Witzke et al. | 423/24 |
| 4,242,127 | 12/1980 | Muller et al. | 423/24 |
| 4,331,475 | 5/1982 | Perfect | 75/27 |
| 4,356,030 | 10/1982 | Halpin et al. | 75/85 |

FOREIGN PATENT DOCUMENTS

| | | | |
|---|---|---|---|
| 0612607 | 11/1948 | United Kingdom | 75/27 |

*Primary Examiner*—S. Kastler

*Attorney, Agent, or Firm*—Michael A. Ciomek; Eugene J. Kalil

[57] ABSTRACT

Waste materials containing chromium, such as the sludge resulting from neutralization of chromic acid bleed streams from metal cleaning and plating operations, are (1) rendered innocuous for land fill purposes by heating to temperatures of at least about 700° C. to stabilize the materials for safe disposal and (2) activated by heating to temperatures of about 400° to 500° and the chromium content in the resulting calcine can be recovered by thermite reduction.

7 Claims, No Drawings

CHROMIUM RECOVERY PROCESS

This application is a continuation of application Ser. No. 043,673 filed Apr. 16, 1987 abandoned.

The invention is directed to a process for treating chromium containing waste materials such as sludges and the like to permit safe disposal and/or recovery of chromium in useful form.

BACKGROUND OF THE INVENTION AND THE PRIOR ART

The most important use of chromium compounds in metal finishing is that of chromic acid in the chromium plating industry, which includes electroplating and metal surface treatment. Bleed streams of some of the process solutions are established in order to minimize the build-up of impurities in chromium treatment solutions. Because of detrimental effects on the environment, disposal of chromium compounds is regulated by federal, state, county, or city ordinances, thus necessitating installation of treatment technologies. A common treatment technology in use involves reduction of chromium (VI) to chromium (III), followed by neutralization and precipitation which removes chromium from the process as trivalent chromium hydroxide. After dewatering, the sludge is typically disposed in landfills. However, this practice is coming under greater scrutiny by the regulating authorities, primarily due to the presence of water-leachable chromium hydroxide. To prevent any leaching of the metal hydroxide, secure and chemically maintained land disposal sites are required. Thus, the disposal costs associated with chromium are high and are continually increasing. The truly pernicious attribute associated with chromium sludge disposal is that the liability exists in perpetuity or as long as the source of the disposed material can be traced. This possibility adds incentive to the quest for a safe disposal system which will protect the environment and protect the disposer as well.

During most of the 19th century, the United States was the principal world producer of chromite. Deposits of chromite were located in Maryland, Pennsylvania, and Virginia. Today, the United States is completely dependent on imports from the U.S.S.R., South Africa, Turkey, and Rhodesia. However, in the past 10 years, imports to the United States have shifted from chromite to ferrochrome. Since world political problems pose a constant threat to interruption of supply, the United States has been forced to maintain large supplies of chromium feedstocks. Thus, from both a strategical and environmental viewpoint, the recycling of chromium from waste solutions or waste sludges is highly desirable.

In the treatment of waste chrome solution, the process may consist of reduction, precipitation, solid/liquid separation and drying. Alternately, concentrated chromium-containing solutions may be evaporated and crystallized, thereby avoiding the reduction, precipitation, and solid/liquid separation processing steps. Also, chromium-containing sludges previously produced can be treated. In the general process for treating chromium-containing solutions, chromium (VI) is reduced to chromium (III). Both chemical reductants and electrolytical reduction can be used for the reduction. Chromium (III) is then precipitated as chromium hydroxide by adjusting the solution pH to about 6. The resulting hydroxide is dewatered by settling and decantation, centrifugation, and/or filtration. Physically adsorbed water is removed by drying the sludge at about 100° C. On the dried basis, the sludges contain on an elemental basis about 5% to about 25% chromium, up to about 15% aluminum, e.g., about 6% to about 15% aluminum, up to about 20% iron, up to about 10% calcium, up to about 5% sodium, up to about 5% magnesium, present as sulfates, carbonate oxide, silicates, oxides, hydroxides, etc.

SUMMARY OF THE INVENTION

In accordance with the invention, the waste chromium containing material is prepared for safe disposal by a roasting step carried out at a temperature exceeding about 700° C. or higher. This step deactivates the waste solid and stabilizes it for safe disposal. The chromium content can be recovered in large part by electric furnace smelting with carbon and fluxes.

Alternatively the chromium content can be recovered in metallic form by the thermite reaction using powdered aluminum, magnesium, silicon or iron and a flux. When the thermite reaction is employed (a desirable alternative since capital costs are low) the waste material is first subjected to an activation heat treatment or calcination in the temperature range of about 300° C. to about 600° . The smelting, which is carried out at temperatures well in excess of 1000° C. provides a molten slag which, when cooled, is inert and a metal button containing chromium as well as other reduced constituents such as iron.

DETAILED DESCRIPTION OF THE INVENTION

It will be appreciated that fluxes are added to enhance the formation of low-melting point slags during smelting, e.g. the thermite reaction, and to promote the separation of the alloy and slag phases, both during and after smelting. The fluxes added can be calcium oxide, calcium fluoride, silicate, or iron oxide. The thermite reaction, which is a pyrometallurgical reduction, can be ignited by using a fuse which consists of a mixture of barium peroxide or sodium peroxide and powdered aluminum. Using powdered aluminum or silicon, the chromium oxide in the activated solid waste can be reduced as shown in the following reactions:

$$Cr_2O_3+2Al=2Cr+Al_2O_3 \quad (1)$$

$$2Cr_2O_3+3Si=4Cr+3SiO_2 \quad (2)$$

If iron oxide is blended with the feed, iron oxide also will be reduced by aluminum and result in the production of a ferrochrome alloy.

$$Fe_2O_3+2Al=2Fe+Al_2O_3 \quad (3)$$

If an excess amount of powdered aluminum is used in the thermite reaction, an Al-Fe-Cr alloy can also be formed.

Waste chrome solutions rich in chromium content can be treated for chromium recovery by evaporation and crystallization. However, the resulting crystals may contain both Cr (VI) and Cr (III) compounds. Since Cr (VI) can also be reduced by solid reductants during the thermite reaction, Cr (VI) does not need to be reduced to Cr (III) prior to the evaporation and crystallization steps. One advantage of processing Cr (VI) containing feeds is the increase in the calorific value during the thermite reaction and enhancement of the separation of the resulting slag and metal phases. However, a disadvantage is that the consumption of solid reductants in the reduction of Cr (VI) to Cr is twice the amount needed for the reduction of Cr (III) to Cr. Comparing Reaction 4 with Reaction 1 illustrates the stoichiometries involved.

$$CrO_3+2Al=Cr+Al_2O_3 \quad (4)$$

The treatment process described can also process existing chrome sludge. However, the process economics are dictated by the chromium content in the sludge. A low-chromium sludge usually contains high levels of inert compounds such as gypsum, calcium hydroxide or aluminum oxide which may act as heat sinks during a thermite reaction and may also inhibit the ignition of a thermite reaction. Therefore, the process is more effective in treating waste sludges containing at least 10 percent chromium, or more preferably, at least about 20 percent chromium.

Examples will now be given.

EXAMPLE 1

A sample of chromium-containing sludge (22.9 percent Cr, 6.2 percent Al, 7.66 percent Fe, and 3.29 percent Ca) was roasted at several temperatures. The material was then used in a standard thermite reaction to investigate the effect of roasting on the subsequent thermite reaction. Test results are shown in Table 1. When some of the moisture was removed in the roast (tests 29A, B, and C), the thermite mixture would burn after ignition with the peroxide fuse at ambient temperature. However, the reaction was not hot enough to give a slag/metal separation. When the weight loss approached 14 to 15 percent during roasting (tests 29D and E), the thermite mixture reacted vigorously, and a metal button was produced. When the sludge was roasted at 500° C., the weight loss increased to 20 percent and the yield of metal increased; however, the thermite reaction was less vigorous.

TABLE 1

Effect of Roasting Temperature on Sludge Reactivity in the Thermite Reaction

| Test No. | Temp. and Time of Preroast | Wt. Loss, % | Thermite Reaction | Slag/ Metal Separt. | Wt. of Slag, g | Wt. of Metal, g |
|---|---|---|---|---|---|---|
| 29A | 200° C., 1 hr | 5.85 | Fair | None | 59.15 | 0.0 |
| 29B | 200° C., 6 hr | 7.71 | Fair | None | 58.74 | 0.0 |
| 29C | 300° C., 1 hr | 12.43 | Good | None | 60.14 | 0.0 |
| 29D | 300° C., 6 hr | 14.26 | Excellent | Yes | 46.15 | 6.54 |
| 29E | 400° C., 1 hr | 14.88 | Excellent | Yes | 51.75 | 9.94 |
| 29F | 500° C., 1 hr | 20.17 | Good | Yes | 53.00 | 12.64 |

EXAMPLE 2

Additional tests were run to study the effect of roasting on the reactivity of chrome sludge in the thermite reaction. Table 2 shows the weight loss, surface area, and thermite reactivity of a chrome sludge as a function of roasting temperature. The feed sludge contained 20.7 percent Cr, 7.5 percent Al, 5.56 percent Fe, and 1.95 percent Ca. The material was roasted for 1 hour at each temperature. The results show that the as-received sludge was pre-dried at about 100° C. and had a very high surface area and a significant percentage of bound water. When the material was reacted in a thermite reaction, the sludge did not react due to the bound water evolving. As the roasting temperature was increased to 200°, 300°, or 400° C., some of this bound water was removed with a slight reduction in surface area. When about 20 percent weight loss was achieved during the roast at 400° C., the sludge became reactive to the thermite process. Increasing the roasting temperature to 500° C. further increased the reactivity of the sludge; however at 700° and 1,000° C., even though moisture removal approached 40 percent, the sludge became less reactive in the thermite reaction due to the significant decrease in surface area. The surface area decrease was probably due to sintering of the sludge. Also, at about 700° C., the sludge became nonhazardous according to the EPA toxicity test.

TABLE 2

Weight Loss, Surface Area, and Reactivity in the Thermite Reaction of Chrome Sludge[a] as a Function of Roasting Temperature

| Temp. of Roast, °C. | % Weight Loss | Surface Area, m /g | Thermite Reaction | Wt. of Metal Button |
|---|---|---|---|---|
| As-Received | -- | 118.2 | None | 0 |
| 200 | 6.2 | 109.5 | None | 0 |
| 300 | 14.8 | 108.1 | Slow Burn | 0 |
| 400 | 19.8 | 78.6 | Rapid Burn | 5.42 |
| 500 | 21.9 | 40.9 | Rapid Burn | 9.42 |
| 700 | 27.3 | 8.3 | Slow Burn | 2.43 |
| 1,000 | 37.6 | 2.2 | None | 0 |

[a]As-received: 20.7% Cr, 7.5% Al, 5.56% Fe, and 1.95% Ca.
[b]One hour residence time at the specified temperature.

EXAMPLE 3

Table 3 shows results that illustrate the effect of roasting on metal recovery in the thermite reaction. Sludge roasted at 300° C. for 6 hours produced a metal button assaying 22.9 percent chromium and 62.8 percent iron. The metal contained 18.5 percent of the original chromium and 50.7 percent of the original iron in the feed composition. By increasing the roasting temperature, both the yield and chromium content of the metal increased. At 500° C., the metal contained 45.5 percent of the chromium in an alloy which analyzed 35.5 percent Cr and 51.5 percent Fe.

TABLE 3

Effect of Roasting Temperature on Sludge Reactivity and Metal Discovery in the Thermite Reaction

| Test No. | Roast Conditions Temp., °C. | Time, hrs | Metal Wt., g | Assay, % Cr | Assay, % Fe | Distr., % Cr | Distr., % Fe |
|---|---|---|---|---|---|---|---|
| 29D | 300 | 6 | 6.5 | 22.9 | 62.8 | 18.5 | 50.7 |
| 29E | 400 | 1 | 9.9 | 24.2 | 65.3 | 24.8 | 74.4 |
| 29F | 500 | 1 | 12.6 | 35.5 | 51.5 | 45.5 | 72.2 |

Note: All of the above tests were run with sludge containing 22.9 percent Cr, 6.2 percent Al, 7.66 percent Fe, and 3.29 percent Ca.

A comparison of results given in Tables 1 through 3 shows that roasting the sludge at 400° to 500° C. removed enough bound water (about 15 to 20 percent weight loss) without severely decreasing the surface area, so that the sludge was effectively reacted in the thermite reaction. Also of importance was the effect of aging after roasting. After two to three weeks of storage, roasted sludge was not as reactive as the freshly roasted material. Apparently, the high surface area of the sludge was effective in adsorption of moisture from the atmosphere which decreased its reactivity with storage time. However, when non-reactive aged samples were reroasted at 400° to 500° C., their thermite reactivity was restored.

EXAMPLE 4

Table 4 shows the results of several tests run to investigate the effect of reagent composition on the slag/metal separation obtained in the thermite reaction. In these tests, the amounts of aluminum, iron oxide, calcium oxide, calcium fluoride, potassium dichromate, or silicon powder were varied in the reactant composition.

Tests 21A and 20C show that better metal recovery was obtained when CaO was used as a flux than when $CaF_2$ was used as a flux. In Test 26C, silicon powder was added to the reaction mixture. Excellent recovery of chromium to the metal phase was obtained, and the metal phase was about 1:1:1, Cr:Fe:Si. In tests 35 and 36F, $K_2Cr_2O_7$ was used instead of $Fe_2O_3$ to add heat to the reaction. Chromium recovery to the metal phase approached 70 percent as an alloy containing almost 70 percent Cr and about 20 percent Fe. Thus, the effect of the reactant composition on metal recovery (particularly Cr) and alloy composition is illustrated by these test results.

TABLE 4

Effect of Reactant Composition on the Thermite Reaction

| Test Conditions | | | | | | | | | | |
|---|---|---|---|---|---|---|---|---|---|---|
| Test No. | 21A | | 20C | | 26C | | 35 | | 36F | |
| Roast Temp, °C.[a] | 400 | | 400 | | 400 | | 500 | | 500 | |
| Sludge Wt., g | 33.6 | | 33.6 | | 33.6 | | 174.3 | | 2043 | |
| Wt. of Additives, g | | | | | | | | | | |
| Al | 9.38 | | 9.38 | | 9.38 | | 57.6 | | 675 | |
| $Fe_2O_3$ | 9.41 | | 9.41 | | 9.41 | | 0 | | 0 | |
| CaO | 4.48 | | 0 | | 0 | | 5.4 | | 63.2 | |
| CaF | 0 | | 4.48 | | 0 | | 0 | | 0 | |
| Si | 0 | | 0 | | 14.1 | | 0 | | 0 | |
| $K_2Cr_2O_7$ | 0 | | 0 | | 0 | | 18.2 | | 212.9 | |
| Test Res. | Metal | Slag | Metal | Slag | Metal | Slag | Metal | Slag | Metal | Slag |
| Product Wt., g | 13.2 | 44.3 | 7.0 | 50.8 | 20.0 | 49.4 | 60.9 | 162.3 | 558.6 | 1830 |
| Assays % | | | | | | | | | | |
| Cr | 27.3 | 14.9 | 27.2 | 16.9 | 32.2 | 6.6 | 68.9 | 9.3 | 64.5 | 12.5 |
| Al | 0.5 | 30.9 | 0.7 | 33.7 | 0.3 | 36.9 | 3.6 | 36.3 | 6.5 | 30.6 |
| Fe | 62.5 | 4.8 | 63.0 | 7.9 | 33.6 | 5.2 | 21.3 | 1.5 | 19.8 | 2.3 |
| Ca | 0.7 | 9.5 | 0.4 | 4.0 | — | — | 0.4 | 6.5 | 0.3 | 5.6 |
| Si | — | — | — | — | 22.2 | 7.2 | — | — | | |
| % | | — | | | | | | | | |
| Distr, % | | | | | | | | | | |
| Cr | 35.3 | 64.7 | 18.2 | 81.8 | 66.4 | 33.6 | 73.5 | 26.5 | 61.2 | 38.8 |
| Al | 0.5 | 99.5 | 0.4 | 99.6 | 0.3 | 99.7 | 3.6 | 96.4 | 6.1 | 93.9 |
| Fe | 79.5 | 20.5 | 45.7 | 54.3 | 72.3 | 27.7 | 84.2 | 15.8 | 72.4 | 27.6 |
| Ca | 2.2 | 97.8 | 0.8 | 99.2 | — | — | 2.1 | 97.9 | 1.5 | 98.5 |
| Si | — | — | — | — | 65.3 | 34.7 | — | — | — | — |

[a]The roasting time was 1 hour at temperature.

Note: All of the above tests were run with sludge containing 22.9 percent Cr, 6.2 percent Al, 7.66 percent Fe, and 3.29 percent Ca.

EXAMPLE 5

The slag and metal phases from Test 36F (see Table 4) were subjected to the EPA toxicity test. Test 36F was selected, since in this test the apparent optimum conditions had been used and the test was the largest run to date. Results shown in Table 5 indicate that the metal and slag phases were acceptable, according to the EPA toxicity test.

TABLE 5

EPA Toxicity Test Results for Slag and Metal Phases from Test 36F

| | Acetic Acid Leachate, ppm | | | | | | | |
|---|---|---|---|---|---|---|---|---|
| Sample | Ag | As | Ba | Cd | Cr | Hg | Pb | Se |
| Slag | 0.01 | 0.053 | 0.097 | 0.005 | 1.55 | 0.01 | 0.118 | 0.1 |
| Metal | 0.01 | 0.042 | 0.083 | 0.005 | 4.61 | 0.01 | 0.118 | 0.1 |
| (Limit, ppm) | (5) | (5) | (100) | (1) | (5) | (0.2) | (1) | (5) |

EXAMPLE 6

Roasting the sludge was necessary to obtain an acceptable thermite reaction. In addition, some of the roasted sludge samples were tested in the EPA toxicity test. Results are shown in Table 6. As-received, the sludge sample did not pass the test with regard to chromium. However, after roasting at 700° to 1,000° C., the sludge passed the test. Apparently, at the higher roasting temperature, the reduction in surface area, along with possible reactions of chromium with iron or other metals to produce spinels (as identified by x-ray analysis), rendered the sludge nonreactive.

TABLE 6

| Roasting Temp., °C. | EPA Toxicity Tests Acetic Acid Leachate, ppm | | | | | | | |
|---|---|---|---|---|---|---|---|---|
| | Ag | As | Ba | Cd | Cr | Hg | Pb | Se |
| As-Rec'd. | 0.01 | 0.70 | 0.053 | 0.20 | 44.2 | 0.01 | 0.12 | 0.1 |
| 400 | 0.01 | 1.55 | 0.035 | 0.23 | 542 | 0.01 | 0.12 | 0.1 |
| 700 | 0.01 | 0.35 | 0.040 | 0.57 | 0.66 | 0.01 | 0.12 | 0.1 |
| 1,000 | 0.01 | 0.16 | 0.024 | 0.15 | 0.38 | 0.01 | 0.12 | 0.1 |
| (Limit, ppm) | (5) | (5) | (100) | (1) | (5) | (0.2) | (1) | (5) |

[a]Chrome sludge containing 22.9% Cr, 6.2% Al, 7.66% Fe, and 3.29% Ca was used as the feed.

EXAMPLE 7

A bleed stream from a chromium plating plant contained 1.05 gpl Cr (IV) and 0.35 gpl Cr (VI). A sample of the stream was boiled to dryness, and the resulting crystals were mixed with iron oxide to give an iron-to-chromium ratio of 1 and a stoichiometric amount of powdered aluminum was added. The mixture reacted vigorously during the thermite reaction. Both the resulting slag and metal phases passed the EPA toxicity leach test.

Although the present invention has been described in conjunction with preferred embodiments, it is to be understood that modifications and variations may be resorted to without departing from the spirit and scope of the invention, as those skilled in the art will readily understand. Such modifications and variations are considered to be within the purview and scope of the invention and appended claims.

We claim:

1. A method for treating sludge material containing at last about 10% chromium in an environmentally leachable form while avoiding detrimentally affecting the environment which comprises:

heating said sludge material to a temperature within the range of about 300° C. to 600° C. for a time sufficient to form an activated product thereof, subjecting said activated product to reduction and smelting at an elevated temperature in excess of 1,000° C. to produce a metallic product comprising chromium and a slag, and then separating said metallic product from said slag, whereby both the slag and the metallic product are in a form non-detrimental to the environment.

2. The method in accordance with claim 1 wherein said smelting and reduction is accomplished using a reductant from the group consisting of aluminum, magnesium, silicon, iron and carbon.

3. The method in accordance with claim 1 wherein said smelting is accomplished by the thermite reaction using a powdered metal reductant from the group consisting of aluminum, magnesium, silicon and iron.

4. The method in accordance with claim 3 wherein said chromium-containing material is first heated at a temperature of about 400° to about 500° C.

5. The method in accordance with claim 1 wherein said sludge contains at least about 20% chromium.

6. The method in accordance with claim 1 wherein the ingredients for said reduction and smelting also include at least one fluxing material to promote the formation of low melting point slags and promote the separation of slag and metal phases.

7. The method in accordance with claim 6 wherein said fluxing materials are selected from the group consisting of calcium oxide, calcium fluoride, silicates and iron oxide.

* * * * *